United States Patent [19]

Hardacre

[11] Patent Number: 4,511,286

[45] Date of Patent: Apr. 16, 1985

[54] FLEXIBLE BARRIERS

[75] Inventor: Nicholas P. Hardacre, Dibden Purlieu, England

[73] Assignee: Leigh Flexible Structure Ltd., Dorset, England

[21] Appl. No.: 315,550

[22] Filed: Oct. 27, 1981

[30] Foreign Application Priority Data

Oct. 27, 1980 [GB] United Kingdom ..... 8034511

[51] Int. Cl.[3] ..... E02B 7/02; E02B 7/20; E02D 5/00; F16M 11/32

[52] U.S. Cl. ..... 405/115; 405/91; 405/227; 248/165

[58] Field of Search ..... 405/91, 107, 90, 114, 405/115, 227, 288, 229; 256/31, 35, 36, 64; 160/229 R, 337; 248/165, 166; 52/71

[56] References Cited

U.S. PATENT DOCUMENTS

| | | | |
|---|---|---|---|
| 565,019 | 8/1896 | Newburg | 405/115 X |
| 1,214,705 | 2/1917 | Neely | 256/31 |
| 1,662,586 | 3/1928 | Newman | 160/377 X |
| 2,723,817 | 11/1955 | Harwood et al. | 248/166 X |
| 3,720,067 | 3/1973 | Aubert | 405/229 X |
| 3,987,636 | 10/1976 | Hruska et al. | 405/227 X |
| 4,136,995 | 1/1979 | Fish | 405/115 |

FOREIGN PATENT DOCUMENTS

| | | | |
|---|---|---|---|
| 843829 | 7/1952 | Fed. Rep. of Germany | 405/90 |
| 1059843 | 6/1959 | Fed. Rep. of Germany | 405/90 |
| 33366 | 10/1921 | Norway | 405/107 |

*Primary Examiner*—Cornelius J. Husar
*Assistant Examiner*—Nancy J. Stodola
*Attorney, Agent, or Firm*—Cushman, Darby & Cushman

[57] ABSTRACT

An interconnected and/or interconnectable frame structure supports a flexible web for use as a barrier surface in a temporary dam spanning across a waterway. The support frame includes a plurality of elongate members which are tilted away from a vertical plane in alternating senses or directions along the spanning direction of the barrier (e.g. transverse to the water flow). The thus resulting zig-zag or sawtooth elongated members are interconnected at their ends to mutually oppose further tilting movements and thus stabilize the frame and barrier structure. Pairs of the elongate members may be hinged (preferably at their lower ends) to facilitate storage and/or erection of pairs the elongate frame members from a flat storage position to an open V-shaped erected position.

17 Claims, 10 Drawing Figures

FLEXIBLE BARRIERS

DESCRIPTION

This invention relates to flexible barriers and may find particular application in temporary dams across waterways or the like.

Such a flexible barrier is described in British Patent Specification No. 2,006,861, and comprises a number of frame members spaced at intervals with a web of flexible material draped across them. The length of the web of flexible material is greater than the span of the frame members so that between the frames the surplus flexible material balloons out when subject to pressure from one side. This occurs with the structure being used as a dam when there is an unbalanced pressure of water on one side and this causes roughly equal sized bags of material to form between the frame members.

The frame members described in the aforementioned specification are generally each disposed in a respective single plane extending perpendicularly from the span of the dam. Such a frame member is shown in side elevation in FIG. 1. It comprises a support rib 1, a back strut 2 and strengthening struts 3. The support rib faces the volume of water to be held by the dam and slopes upwardly away from this direction to meet the back strut 2 which is upright. The back strut 2 may be hollow and receive an anchoring picket which is embedded into the bed of the waterway. Alternatively the anchoring picket may be connected to the back strut by guides allowing the picket to move parallel thereto when it is forced perpendicularly into the bed of the waterway. In an alternative arrangement the picket may also take the place of the back strut.

Flexible barriers of the kind described in the aforementioned specification suffer from a tendency of the frame members to tilt sideways, or to slew round to a non-perpendicular angle to the face of the barrier. Such misalignment can result in adjacent large and small bags of material being formed to the side of the misaligned frame, the differential force from which is likely to cause a further slewing of the frame member and possible collapse of the structure.

The present invention seeks to provide a flexible barrier which is more resistant to distortion due to sideways instability of the frame members.

According to the present invention there is provided a barrier comprising support means and a flexible web providing the barrier surface, the support means being situated behind the flexible web and including a plurality of first support members that are tilted in the spanning direction of the barrier and are each connected with a respective second support member disposed to oppose movement of the corresponding first support member in its direction of tilt.

The pairs of first and second support members may be elongate support ribs and may both be tilted, but in opposite directions, in the direction of the span of the barrier and may be connected at or near their intersection.

Each support rib may be the web-supporting member of a generally flat support frame. Adjacent support frames including respectively first and second support ribs of different but adjacent ones of said pairs of support ribs may be joined by a hinge connection at or near their lower ends, the hinge enabling these two support frames, when otherwise unconstrained, to be collapsed to a generally flat condition.

The present invention, in a preferred form, provides as component parts of the support for a flexible barrier pairs of said hinge-connected support frames.

The support frames may be secured to the ground by stakes moveably connected to the frames by guide means to enable the stakes to be driven into the ground.

The stakes are preferably connected to said support frames so that they extend generally in the plane of the frame and enter the ground at an acute angle. The hinge-connected support frames may have associated stake-guiding means which respectively ensure that the associated stakes are spaced such that they may cross without fouling.

Embodiments of the invention will now be described by way of example only, with reference to FIGS. 2–8 of the accompanying drawings. In the drawings.

Figure 1:
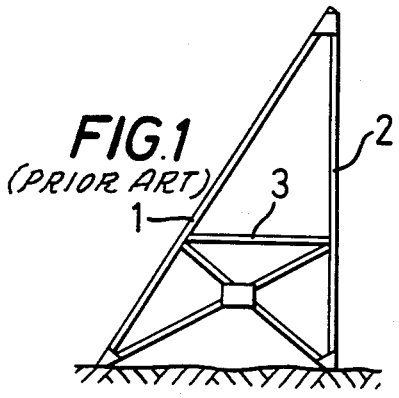
FIG.1 (PRIOR ART)
FIG. 1 is a side elevational view of a prior art flexible barrier.
Figure 2:
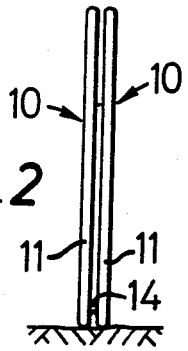
FIG. 2 is an elevational view from the front of a pair of support frames for a flexible dam, the pair of frames being shown in a collapsed state.
Figure 3:
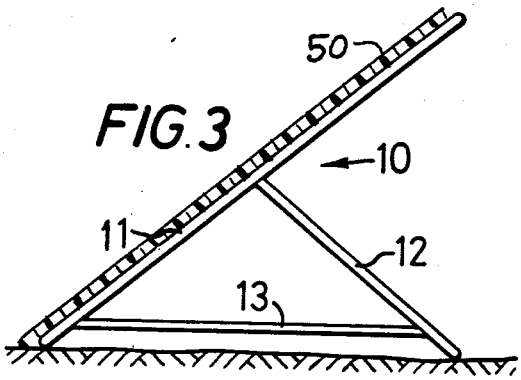
FIG. 3 is a side elevational view of the pair of frames of FIG. 2.

Referring to FIGS. 2 and 3, a support frame 10 for a flexible dam comprises a web-supporting rib 11, a rearwardly extending strut 12 and a horizontal tie 13. The web-supporting rib is angled to the ground such that its upper end is rearward of its lower end. The angle of inclination is chosen with regard to the properties of the bed of the waterway, such as its coefficient of friction.

Figure 4:
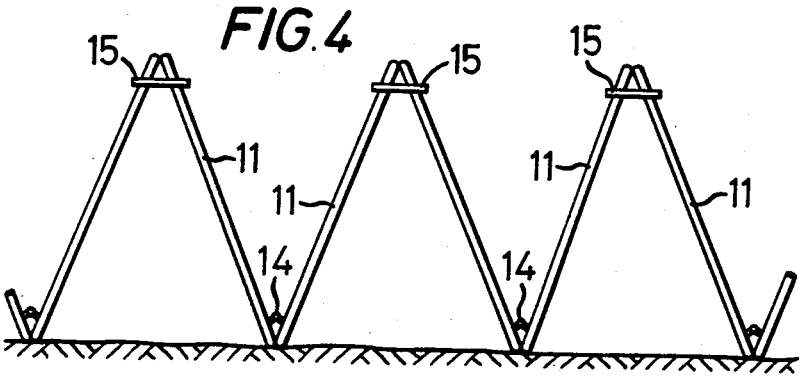
FIG. 4 shows an interconnected assembly of pairs of frames in an extended state.

A pair of such support frames are connected by a hinge 14 at corresponding points on the tie bar 13 which extends close to the base of the frame. As illustrated in FIG. 2 the pair of frames may be collapsed by pivoting about the hinge 14 to a generally flat stage. These pairs of frames can be stored and handled in their collapsed condition. When located the frames are opened and placed adjacent other such frames in the manner shown in FIG. 4. The upper portions of adjacent support ribs 11 from different hinge-connected pairs are connected by clamps 15. Thus the clamped, adjacent support ribs support one another mutually opposing further tilt. When so clamped a continuous saw-tooth support structure for the web 50 is formed across the bed of a waterway.

Figure 5:
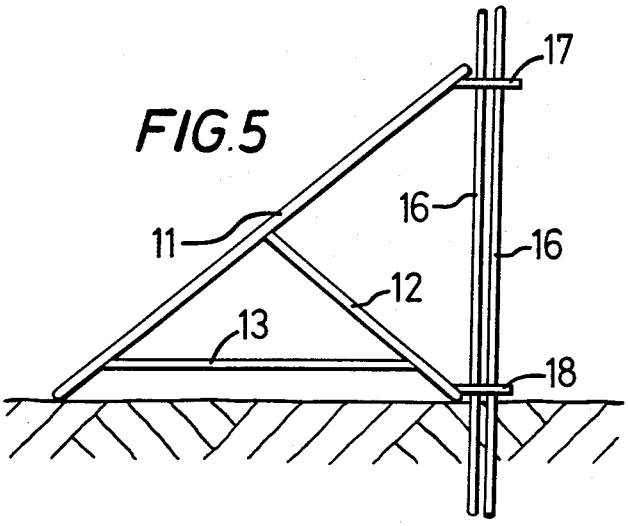
FIG. 5 is a side elevational view of a support frame and fixing stake.
Figure 6:
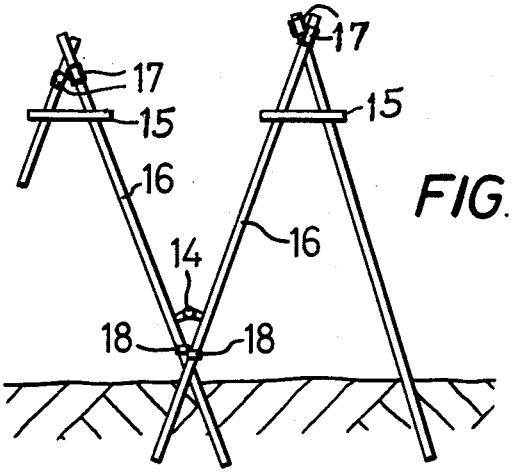
FIG. 6 is a rear view of a pair of support frames and fixing stakes.
Figure 7:
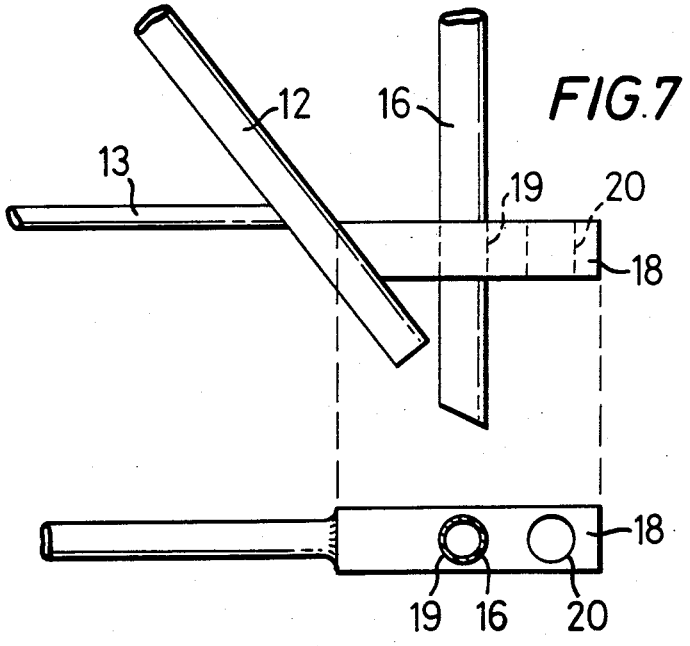
FIG. 7 is a diagrammatic view of a guide connection between a support frame and fixing stake.

As shown in FIGS. 5 and 6, each frame is equipped with a back picket 16 which is driven into the bed when the pairs of frames have been opened up and clamped together. The pickets 16 are located with respected to the frames by guides 17, 18 on respectively the rib 11 and the lower end of the strut 12 of each frame. Each picket 16 thus follows the tilting of the frame to which it is connected. The pickets associated with each of a pair of hinge-connected frames therefore must cross. This is accommodated by spacing the pickets by means of alternative apertures 19, 20 in each of the guides 17, 18 as is illustrated in FIG. 7. The pickets are normally lifted into the waterway with their associated pair of frames, and the pickets are raised relative to the frames and held in place by a pin or some other means so that the bottom of the picket is level with the bottom of the frame.

It will be appreciated that by locking the frames together in this manner there is greater resistance on the part of the frames to slewing than in the prior art-type dams. Since, in a horizontal direction, wider parts of the bags alternate with narrow parts, a large bag of material cannot form between the frames and render the dam unstable.

The pickets are included to prevent the frames both from sliding back and from sinking in the bed of the waterway. When the pickets are driven in crossed-over pairs as described above, there is improved resistance to sinked compared with the use of vertical pickets. The resistance offered to vertical sinking and horizontal sliding both put a considerable bending load on the bottom of the picket, so it is sometimes advantageous to reinforce the lower portion of it.

Figure 8:
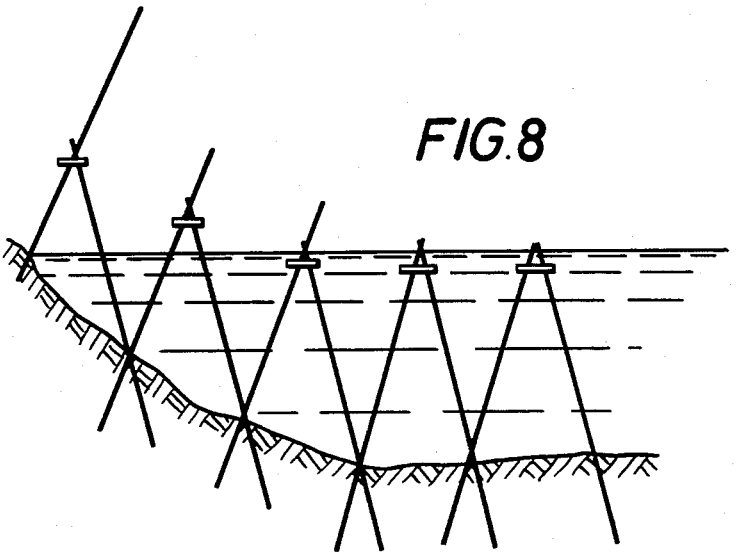
FIG. 8 is a diagrammatic view of flexible dam erected across a river bed.

FIG. 8 shows diagrammatically an arrangement of frames across a river bed and it can be seen that the slope of the banks causing the frames to be at different heights can be accommodated by the clamps used to hold the tops of adjacent frames together. It will be appreciated that in constructing a dam in accordance with the above described embodiment of the invention no connections between the frames need to be made beneath the water.

Figure 9:
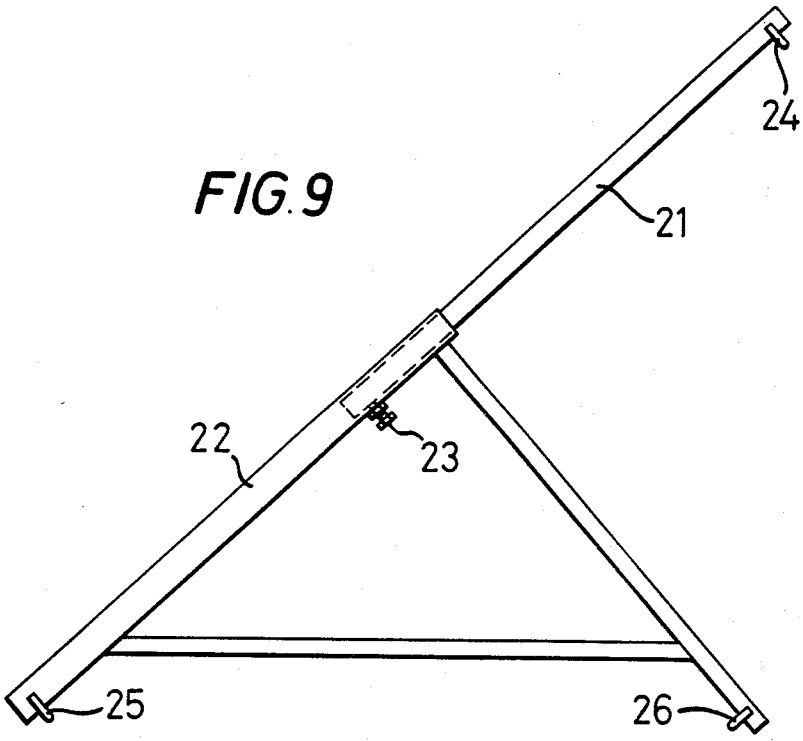
FIG. 9 is a elevational view of an alternative frame construction.
Figure 10:
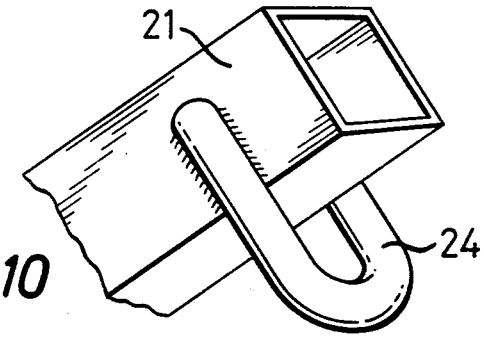
FIG. 10 is an enlarged perspective view of part of the frame shown in FIG. 9.

Referring now to FIGS. 9 and 10, in a further embodiment of the invention the frames are modified such that the web-supporting rib comprises two telescopically-mounted portions 21 and 22. A clamping bolt 23, extends through the outer portion where the portions overlap and presses against the inner portion so that the length of the web-supporting rib can be varied and clamped at a desired extension.

At the top and bottom of the web-supporting rib there are welded u-shaped lugs 24, 25 these are overlapped with corresponding lugs on adjacent frames and connected by a shackle. A similar lug 26 is included at the foot of the rearwardly-extending strut for shackling to a similarly located strut on an adjacent frame.

The advantage of this construction is that when the frames are positioned across an uneven waterway as in FIG. 8, by telescopic retraction their heights can be made equal enabling them to be shackled using the lugs 24. In this way the need for the type of clamps 15 previously described can be eliminated, and the same clamping arrangement is then used for the hinge at the bottom and the clamp at the top of the frames.

A dam having a uniform height may be advantageous in certain circumstances for example where an even overflow is required.

I claim:

1. A barrier which may be extended in a spanning direction across a waterway transverse to the direction of gravity-directed waterflow, said barrier comprising:

support means and a flexible web supported thereby and which provides a barrier surface impeding the waterflow, the support means being situated behind the flexible web and including a plurality of support members presenting a common transverse support surface for said web, individual ones of said support members being tilted in alternating opposite directions within said common support surface and along the spanning direction of the barrier and each being connected with a respective similar support member disposed to mutually oppose further tilting movement within said common support surface.

2. A barrier for extending in a spanning direction transversely across a watercourse, said barrier comprising:

support means and a flexible web supported by the support means, the flexible web providing an upstanding barrier surface, said support means being situated behind the flexible web and providing a common support surface including a plurality of first support members tilted along said spanning direction at said common support surface and away from a vertical plane and a plurality of second support members also tilted along said spanning direction at said common support surface and away from a vertical plane but in an opposite sense from the tilt of said first support members, each second support member being interleaved between and connected to respective first support members to mutually support such members against movement that increases their respective angles of tilt.

3. A barrier as claimed in claim 2 wherein the first and second support members each comprise first and second elongate ribs tilted along said spanning direction away from each other and away from a vertical plane so that successive interconnected alternate first and second support members produce a "saw tooth" structure.

4. A barrier as claimed in claim 3 wherein each support rib is part of a flat co-planar support frame.

5. A barrier as claimed in claim 4 wherein, except for support frames disposed at the ends of the barrier, each support frame includes a first support rib joined to an adjacent support frame and also joined to a second support rib by a hinge connection at or near their respective lower ends, the hinge enabling these two hinge-connected support frames, when otherwise unconstrained, to be collapsed to a flat stage for storage purposes.

6. A barrier as claimed in claim 4 or claim 5 including locating stakes, each slidably connected to a respective frame by guide means on the frame which enable the stake to be driven into the ground.

7. A barrier as claimed in claim 6 wherein each locating stake is connected to its respective support frame so that it extends approximately parallel to the support rib of the frame and hence, when located, enters the ground at an acute angle.

8. A barrier as claimed in claim 7 wherein pairs of support frames connected by a hinge have respective guide means for their associated stakes disposed such that the stakes may cross without fouling.

9. A barrier as claimed in claim 2 located across a body of water and acting as a flexible dam.

10. A barrier as claimed in claim 4 wherein the support means comprise telescopically mounted parts enabling the height of the support means to be adjusted.

11. A support frame for a flexible water course barrier, said support frame comprising:

a first co-planar support frame having upper and lower portions and a forwardly positioned web-supporting rib;

a second co-planar support frame having upper and lower portions and a forwardly positioned web-supporting rib; and hinge means hingedly linking the lower portions of said first and second support frames which first and second co-planar support frames are disposed in a common plane.

12. A support frame as in claim 11 wherein said hinge means comprises a U-shaped lug affixed to the lower portion of each said co-planar support frame.

13. A support frame as in claim 11 wherein said hinge means comprises a rotatable hinge joint linking said lower portions.

14. A support frame as in claim 11, 12 or 13 further comprising clamp means for clamping together the upper portions of adjacent co-planar support frames where a plurality of pairs of said first and second co-planar support frames are arrayed in succession and each pair is opened at said hinge means to provide a V-shaped support frame thereby locking such plural pairs into a stable composite support structure.

15. A support frame as in claim 14 wherein said clamp means comprises a U-shaped lug affixed to the upper portion of each said co-planar support frame.

16. A support frame as in claim 14 wherein said clamp means comprises a rigid cross-piece.

17. A support frame as in claim 14 wherein each said co-planar support frame includes a locating stake slidably connected thereto by guide means carried on the rear of the frame.

* * * * *